United States Patent [19]

Thompson

[11] Patent Number: 4,594,582

[45] Date of Patent: Jun. 10, 1986

[54] FLOATING ALARM UNIT FOR POOL OR SPA

[76] Inventor: Stanley C. Thompson, 7851 Talbert St., Apt. 1, Playa del Rey, Calif. 90271

[21] Appl. No.: 514,493

[22] Filed: Jul. 18, 1983

[51] Int. Cl.[4] ..... G08B 13/00

[52] U.S. Cl. ..... 340/566; 340/693

[58] Field of Search ..... 340/566, 565, 623, 693; 200/61.48, 61.93

[56] References Cited

U.S. PATENT DOCUMENTS

| | | | |
|---|---|---|---|
| 3,036,296 | 5/1962 | Conte | 340/565 |
| 3,038,151 | 6/1962 | O'Connor, Jr. et al. | 340/566 |
| 3,054,096 | 9/1962 | Peritz . | |
| 3,092,822 | 6/1963 | Dorman | 340/565 |
| 3,276,007 | 9/1966 | White | 340/566 |
| 3,359,550 | 12/1967 | Christensen . | |
| 3,636,544 | 1/1972 | Codina . | |
| 3,683,353 | 8/1972 | Miller . | |
| 3,778,803 | 12/1973 | Jahn | 340/566 |
| 3,786,469 | 1/1974 | Massaro et al. | 340/566 |
| 3,953,843 | 4/1976 | Codina . | |
| 4,069,405 | 1/1978 | Fima . | |
| 4,203,097 | 5/1980 | Manning | 340/566 |
| 4,333,094 | 6/1982 | Osborne | 340/566 |
| 4,408,193 | 10/1983 | Millen | 340/566 |

*Primary Examiner*—Glen R. Swann, III
*Assistant Examiner*—Thomas J. Mullen, Jr.
*Attorney, Agent, or Firm*—William W. Haefliger

[57] ABSTRACT

A pool alarm includes a float body, a hollow container received in the hollow body; and tilt sensing mechanism in the hollow container to be placed in alarm mode when a water wave tilts the body.

10 Claims, 5 Drawing Figures

FLOATING ALARM UNIT FOR POOL OR SPA

BACKGROUND OF THE INVENTION

This invention relates generally to alarm units, and more particularly to improvements in pool or spa alarms.

Examples of such units, and related units, are found in the following U.S. Pat. Nos.: 3,054,096 to Pertiz, 3,683,353 to Miller, 3,786,469 to Massaro, 3,636,544 to Codina, 3,953,843 to Codina, 3,359,550 to Christensen, 3,778,803 to Jahn, 4,069,405 to Fima, 3,276,007 to White, 3,038,151 to O'Connor, 4,333,094 to Osborne, Such prior units are undesirably complex or impractical in construction, circuitry and modes of operation, and/or results, so that there is need for a simple, practical unit which will meet the needs for pool or spa safety, i.e. provide an alarm when a surface wave is produced.

SUMMARY OF THE INVENTION

It is a major object of the invention to provide a pool or spa alarm unit which overcomes the above problems and disadvantages. Basically, the unit comprises, in combination, (a) a float body adapted to float on a pool of water, (b) a hollow container received in an opening formed by said body to be carried by the body, and (c) tilt sensing means in said hollow container to be placed in an alarm mode in response to water wave induced tilting of said body.

As will be seen, the container typically includes a removable lid, the tilt sensor as well as other circuit elements suspended from the lid to be easily accessible in response to removal of the lid from the container, the lid on the container acting to seal off the space in the container that receives the circuitry and tilt sensor. The latter typically includes a pendulum that hangs with clearance in an opening formed by a metal part adapted to be contacted by the pendulum as the unit tilts, that part also carried by the lid, accordingly, the lid has multiple functions.

Further, the float body may be annular to centrally receive the sealed container, and the lid is centered on the container so that the weight of the circuitry, pendulum and associated structure is centered at the container for balanced floating purposes, the pendulum then hanging with equal clearance in all directions in the circular opening. Finally, a tether line may anchor the floating unit at a selected location on the pool surface.

These and other objects and advantages of the invention, as well as the details of an illustrative embodiment, will be more fully understood from the following specification and drawings, in which:

DRAWING DESCRIPTION

DETAILED DESCRIPTION

Figure 1:
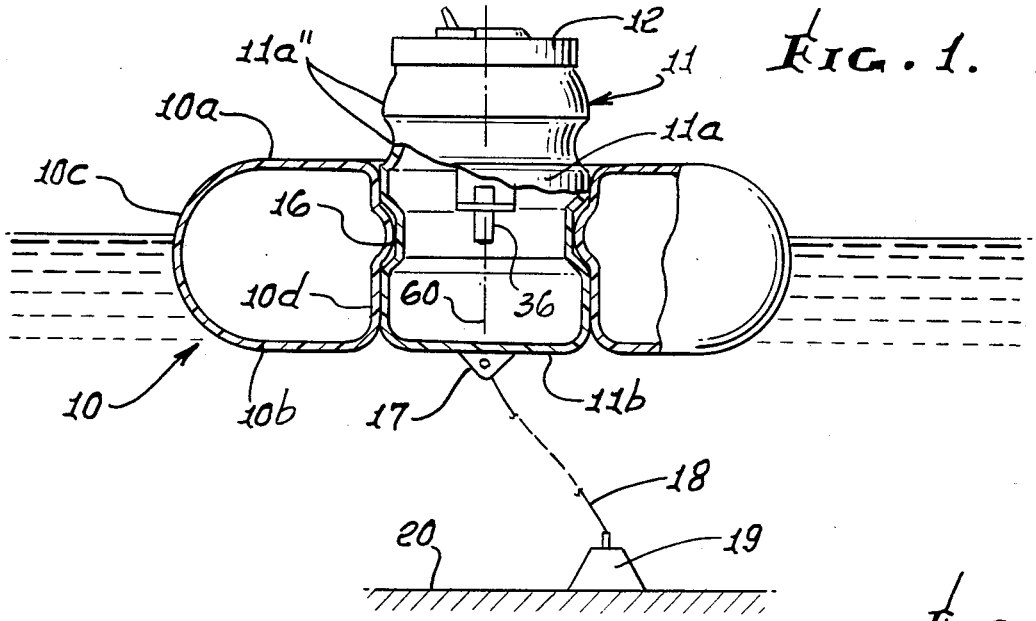
FIG. 1 is a side elevation, partly in section, showing a floating pool alarm unit.
Figure 2:
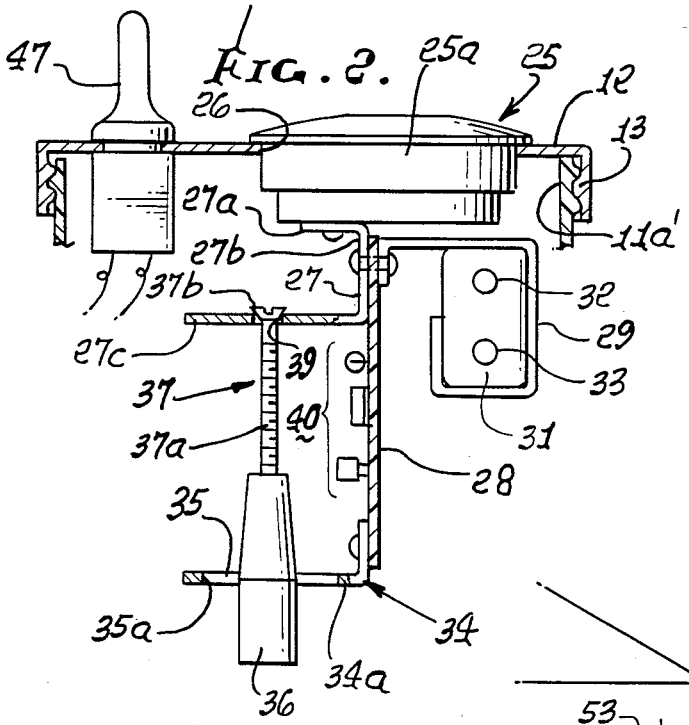
FIG. 2 is an enlarged elevation showing circuit element structure.

In FIG. 1, an annular float 10 may consist of thin, molded synthetic resin having top and bottom walls 10*a* and 10*b*, annular, outwardly convex outer wall 10*c*, and inner annular wall 10*d*. The float 10 supports a container 11 at the central vertical opening defined by the inner wall 10*d*. Container 11 includes annular side wall 11*a*, bottom wall 11*b*, and a lid 12 attached, as by screw threading 13, to the upper rim portion 11*a'* of the side wall 11*a* (see FIG. 2). Accordingly, the lid is removable from the container side wall (to permit circuit adjustment or repair) and when in place the lid seals off the hollow interior 15 of the container.

Figure 3:
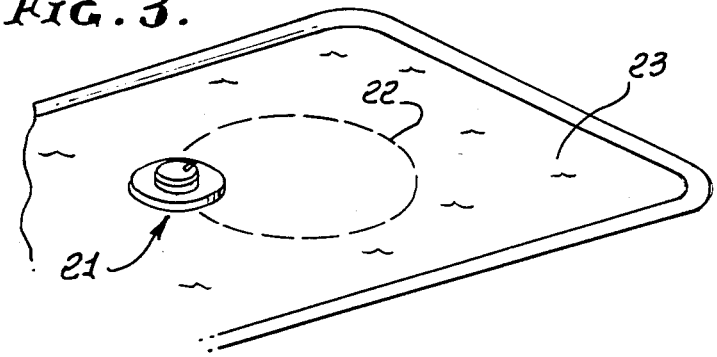
FIG. 3 is a perspective view showing a pool with a floating alarm unit.

The container may also consist of molded synthetic resin. It may, with unusual advantage, have interference fit at 16 with the bore of the float inner wall 10*d*, so that it stays in place when pushed into that bore. To stiffen side wall 11*a* at the locus of the interfit, the side wall projecting above the float level may be annularly corrugated, as shown at 11*a''*. A liquid bonding agent may be applied to either of the walls 10*d* and 11*a*, to facilitate their interfit assembly, after which the agent cures to bond those walls together. Bottom wall 11*b* may carry a molded projection 17 to which a tether line 18 is connectible, as shown. A weight 19 on the lower end of line 18 falls to the bottom 20 of the pool, anchoring the unit 21 to float within a selected boundary as indicated by broken lines 22 in FIG. 3, on the pool water surface 23. Thus, the unit may be selectively located in the pool, in a zone of selected wave action. The molded resin of the float and container is selected to resist deterioration when contacted by chlorinated pool water. Examples of such resin are high density polyethylene.

Also provided on the unit 21 is means to produce an audible signal in response to momentary tilting of the unit, as caused by a surface wave (produced for example when an infant or pet falls in, or struggles against drowning, in the pool. Such means is shown carried by, and in part suspended from the lid 12; thus, a housing 25*a* for loudspeaker 25 is attached to the lid horizontal wall, as by fitting into lid wall opening 26.

Suspended from the bottom side 11*b* of container 11 is a metal bracket 27 having branches 27*a*, 27*b* and 27*c*. An insulative circuit board 28 is attached to vertical branch 27*b*, branch 27*a* being attached to the underside of housing 25*a*. A second bracket 29 attached to insulative board 28 carries a power supply, as for example a small storage battery 31, having terminals 32 and 33. The lowermost extent of board 28 carries an L-shaped metal bracket 34 having a horizontal branch 34*a*. The latter, which is electrically conductive, forms a circular opening 35 which opens vertically to pass a conductive metal (as for example brass) pendulum 36 the cylindrical diameter of which is less than the diameter of opening 35. Annular clearance is formed between the pendulum and the edge 35*a* of opening 35, when the float remains untilted, i.e. the pool surface is not transmitting surface waves.

The pendulum is in turn suspended from a bolt 37 having a threaded shank 37*a* adjustably interfitting the pendulum to enable selection of the vertical position of the pendulum relative to the opening. In addition, the pendulum may be lengthwise tapered. Accordingly, the clearance at 35 may be selectively increased or decreased, to vary the response of the audible unit in accordance with the amplitude of waves required to tilt the unit sufficiently to actuate the alarm. Note that the head 37*b* of the bolt 37 is tapered to easily rock universally in the annular seat 39 formed by the bracket branch 25*c*. When the pendulum engages edge 35*a* of opening 35, due to sufficient tilting of the alarm unit, an electrical contact is then made, effectively signaling the circuitry 40 in the board 28, which then causes activation of the loudspeaker.

Figure 4:
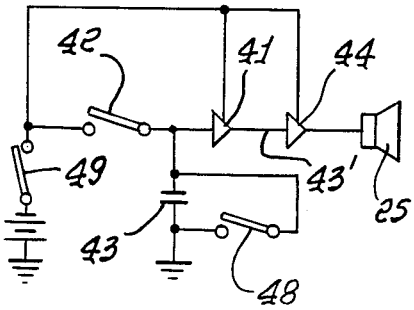
FIG. 4 is a circuit diagram.

FIG. 4 shows one simple circuit 40 to include a first amplifier 41 to sense closing of the switch 42 (caused by contact of the pendulum with edge 35*a* as described). A latch circuit, as represented by capacitor 43, is then activated (for example electrical charge is stored). The amplifier is then biased 'ON' by such charge, and the amplifier output at 43' causes the speaker driving amplifier 44 to activate the speaker 'ON', as for example by a beep output. This continues despite disengagement of the pendulum from contact with edge 35*a*. To shut off the speaker, toggle switch arm 47 is deflected, which effectively closes a switch 48 in circuitry 40. Merely by way of example, switch 48 may discharge the capacitor (i.e. open the latch), which biases amplifier (transistor) 41 'OFF', which in turn shuts off driver amplifier 44. ON-OFF switch arm 49 may be ganged with switch arm 48.

Figure 5:
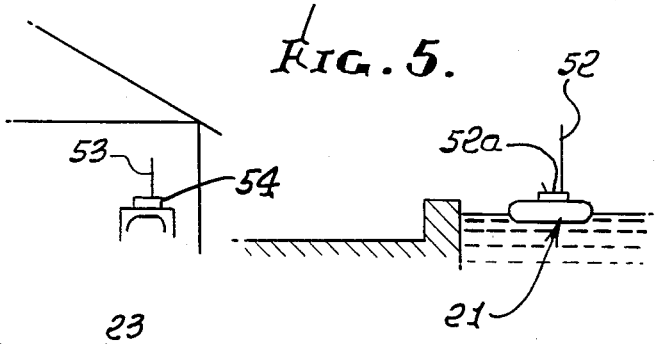
FIG. 5 is a view showing remote signaling from a floating pool alarm unit.

FIG. 5 shows the provision for remote alarm signaling. Antenna 52 on transmitter 52*a* at the unit 21 transmits, by radio link, an alarm signal to remote receiver antenna 53, when unit 21 tilts due to wave action. The receiver circuitry at 54 is then activated to provide the alarm, as for example an audible (loud speaker or buzzer) signal. Other signal outputs such as flashing lights, may be utilized.

Note in FIG. 1 that the pendulum 36 is generally centrally located proximate the vertical axis 60 defined by the float 10 and container 11, to be equally sensitive, as by tilting, to contact edge 35*a* in response to waves arriving at the float from any azimuthal direction.

I claim:

1. In a pool or spa alarm unit, the combination comprising:

(a) a float body adapted to float on a pool of water, said body being annular and forming a central vertical through opening, the body being annularly hollow about said through opening, (b) a hollow container protectively vertically received in said opening formed by said body to be attached to an inner wall formed by said annular body and to be carried by the body, said container and hollow body having thin, annular flexible, correspondingly annularly corrugated walls which have interfering, annular tonge and groove interfit inwardly of the hollow in the float body and outwardly of the hollow in the container, the bottom of the hollow container being substantially flush with the bottom of the hollow body, and (c) tilt sensing means in said hollow container and within said central opening, to be placed in an alarm mode in response to water wave induced tilting of said body, (d) said container including a removable lid attached to the container above the level of the annular body, said tilt sensing means carried by the lid to be accessible in response to removal of the lid from the container, (e) and said tilt sensing means including a pendulum suspended by said lid, and circuitry responsive to swinging of the pendulum to produce an alarm signal, (f) the pendulum surrounded by said annular float body.

2. The combination of claim 1 wherein said circuitry includes a metal part defining an opening passing the pendulum and adapted to be contacted by the pendulum in response to said swinging in any direction.

3. The combination of claim 2 wherein said circuitry including said metal part is carried by said lid.

4. The combination of claim 3 wherein said circuitry includes a loud speaker, and battery.

5. The combination of claim 1 wherein said body and container consist of molded synthetic resin, said container and hollow body having thin, annular walls which have interfering, annular tongue and groove interfit inwardly of the hollow in the float body and outwardly of the hollow in the container.

6. The combination of claim 5 wherein said lid is screwed onto the container at a level above the level of the annular body, whereby the interior of the container is sealed off from the exterior.

7. The combination of claim 5 wherein said body and container are bonded together.

8. The combination of claim 1 including means at the underside of said unit for providing a tether connection.

9. The combination of claim 8 wherein said means includes a tether line connected to said unit, and an anchor on said line.

10. The combination of claim 2 wherein said body is generally annular and has a vertical central axis; and said pendulum is carried by the lid to be located proximate said axis.

* * * * *